US008745945B2

(12) United States Patent
Minamikawa

(10) Patent No.: US 8,745,945 B2
(45) Date of Patent: Jun. 10, 2014

(54) FURRING STRIP FASTENING MEMBER AND CONSTRUCTION STRUCTURE USING SAME

(75) Inventor: Masaya Minamikawa, Nagoya (JP)

(73) Assignee: Nichiha Corporation, Nagoya-Shi (JP)

( * ) Notice: Subject to any disclaimer, the term of this patent is extended or adjusted under 35 U.S.C. 154(b) by 32 days.

(21) Appl. No.: 13/559,649

(22) Filed: Jul. 27, 2012

(65) Prior Publication Data

US 2013/0025235 A1 Jan. 31, 2013

(30) Foreign Application Priority Data

Jul. 28, 2011 (JP) ..... 2011-165914

(51) Int. Cl.

| | |
|---|---|
| ***E04B 2/00*** | (2006.01) |
| ***E04B 5/00*** | (2006.01) |
| ***E04B 9/00*** | (2006.01) |
| ***E04B 1/98*** | (2006.01) |

(52) U.S. Cl.
USPC ..... 52/506.01; 52/167.1

(58) Field of Classification Search
USPC ..... 52/167.1, 506.01, 506.06, 506.09, 52/506.1, 512
See application file for complete search history.

(56) References Cited

U.S. PATENT DOCUMENTS 7,028,432 B2 * 4/2006 Manos et al. ..... 52/167.1

FOREIGN PATENT DOCUMENTS

JP 2006-090045 A 4/2006

* cited by examiner

*Primary Examiner* — Mark Wendell
(74) *Attorney, Agent, or Firm* — Birch, Stewart, Kolasch & Birch, LLP

(57) ABSTRACT

A furring strip fastening member comprises a furring strip receiving plate having a through-hole and a female thread section latching section, a rear face plate having a through-hole, a spring section and a female thread section. The spring section connects the furring strip receiving plate and the rear face plate. The female thread section has a through-hole having a thread formed in the inner periphery thereof, and is latched by the female thread section latching sections. In the construction structure for a building, the furring strip fastening member is connected to skeleton wall of building that is formed of concrete wall and a heat insulating material disposed outside the latter, in a state where the female thread section is screwed to the bolt. The furring strip receiving plate presses against the furring strip and the rear face plate presses against the heat insulating material.

11 Claims, 7 Drawing Sheets

FURRING STRIP FASTENING MEMBER AND CONSTRUCTION STRUCTURE USING SAME

BACKGROUND OF THE INVENTION

1. Field of the Invention

The present invention relates to a furring strip fastening member that is used for fastening a furring strip to a skeleton wall of a building made of concrete, for instance reinforced concrete, pre-cast concrete, lightweight aerated concrete or the like, with a predetermined spacing being provided between the furring strip and the skeleton wall.

2. Description of the Related Art

In conventional techniques, heat insulating materials are installed to the exterior of skeleton walls in buildings made of concrete, an air layer is provided outward of the heat insulating material, and then siding is attached, with the air layer interposed in between. For instance, Japanese Patent Application Laid-open No. 2006-90045 discloses an exterior finishing material fastening fixture comprising a channel that is supported by a bolt to which there is mounted a reinforcing member having a female thread section and a fixing section, and by a bolt fixed to a concrete outer wall. The reinforcing member can be screwed, by way of the female thread section thereof, to a male thread section of the bolt, and the fixing section can be fixed to the concrete outer wall.

In order to fix the heat insulating material to a concrete wall in the exterior finishing material fastening fixture set forth in Japanese Patent Application Laid-open No. 2006-90045, however, a separate heat insulating material must be fixed by way of a heat insulating material fixing plate, which is troublesome. Also, the heat insulating material fixing plate may loosen over time, or on account of earthquakes or the like, whereby fixing of the heat insulating material may become insufficient.

SUMMARY OF THE INVENTION

It is an object of the present invention to provide a furring strip fastening member, and a construction structure that uses the furring strip fastening member, that allow fixing a heat insulating material over long periods of time by way of a simple structure.

The present invention provides a furring strip fastening member and a construction structure for buildings that uses the furring strip fastening member.

The furring strip fastening member is a furring strip fastening member used for fastening a furring strip to the skeleton wall of a building, with a predetermined spacing being provided there between, and has a furring strip receiving plate, a rear face plate, a spring section and a female thread section. The furring strip receiving plate and the rear face plate are shaped as flat plates that face each other. The furring strip receiving plate has, in a central portion thereof, a through-hole, and a protruding female thread section latching section. The rear face plate has a through-hole at a central portion thereof. The spring section connects the furring strip receiving plate and the rear face plate. The female thread section has a through-hole having a thread formed in the inner periphery thereof, and is latched by the female thread section latching section. The through-hole of the furring strip receiving plate, the through-hole of the female thread section and the through-hole of the rear face plate are provided along a straight line. By virtue of the above features, the furring strip fastening member of the present invention can be fixed to the structure skeleton of a building via a bolt, and the furring strip receiving plate can press against the furring strip and the rear face plate can press against the heat insulating material, over long periods of time, on account of the reaction of the spring section. Also, the female thread section is latched by the female thread section latching section that is provided in the furring strip receiving plate. Therefore, the female thread section is less likely to come off the furring strip receiving plate than in an instance where the female thread section is integrally formed with the furring strip receiving plate. As a result, loosening of the bolt is suppressed, and the furring strip fastening member is fixed firmly. In the furring strip receiving plate, the female thread section latching section may be provided protruding so as to face the rear face plate, or may be provided so as not to face the rear face plate. In the former case, the female thread section is latched between the furring strip receiving plate and the rear face plate, while in the latter case the female thread section is latched outward of the furring strip receiving plate. Both instances are non-problematic, and allow achieving the above-described effect.

Preferably, the furring strip receiving plate has, at the outer edge, a bent flange, since in that case the furring strip receiving plate has high strength.

Preferably, the rear face plate is substantially circular, since in that case the position of the furring strip receiving plate can be easily adjusted, by causing the rear face plate to rotate while being pressed against the heat insulating material, during installing of the furring strip fastening member. The substantially circular shape may be circular or may be a polygon having five or more angles.

Preferably, the furring strip receiving plate and the rear face plate have spring section latching sections that latch the spring section, since in this case the furring strip receiving plate, the rear face plate and the spring section form a single whole, which facilitates installing. The position of the furring strip receiving plate is adjusted by causing the rear face plate to rotate while being pressed against the heat insulating material, during installing of the furring strip fastening member. Preferably, therefore, the spring section latching sections are provided, in the rear face plate, on the side that faces the furring strip receiving plate.

The present invention provides also a construction structure for buildings, in which a furring strip is fastened to a skeleton wall of a building using the above-described furring strip fastening member. In the construction structure for buildings of the present invention, the skeleton wall of the building comprises a concrete wall and a heat insulating material disposed outside the concrete wall; an anchor is driven into the skeleton wall of the building; a bolt is mounted to the anchor; the furring strip fastening member is connected in a state where the bolt traverses a through-hole in a rear face plate and the bolt and the female thread section are screwed together; the furring strip is connected to the furring strip fastening member; and siding is fastened to the furring strip. In the furring strip fastening member, the furring strip receiving plate presses against the furring strip and the rear face plate presses against the heat insulating material, on account of the reaction of the spring section.

In the construction structure in a building of the present invention, preferably, the position of the furring strip is adjusted on the basis of the degree of screwing between the bolt and the female thread section of the furring strip fastening member, since in that case no unevenness occurs upon installing of the siding.

The present invention succeeds thus in providing a furring strip fastening member, and a construction structure that uses the furring strip fastening member, such that a heat insulating material can be fixed over long periods of time, by way of a simple structure.

DESCRIPTION OF THE PREFERRED EMBODIMENTS

An explanation follows next on an embodiment of the furring strip fastening member of the present invention and an embodiment of a construction structure that uses the furring strip fastening member.

Figure 1:
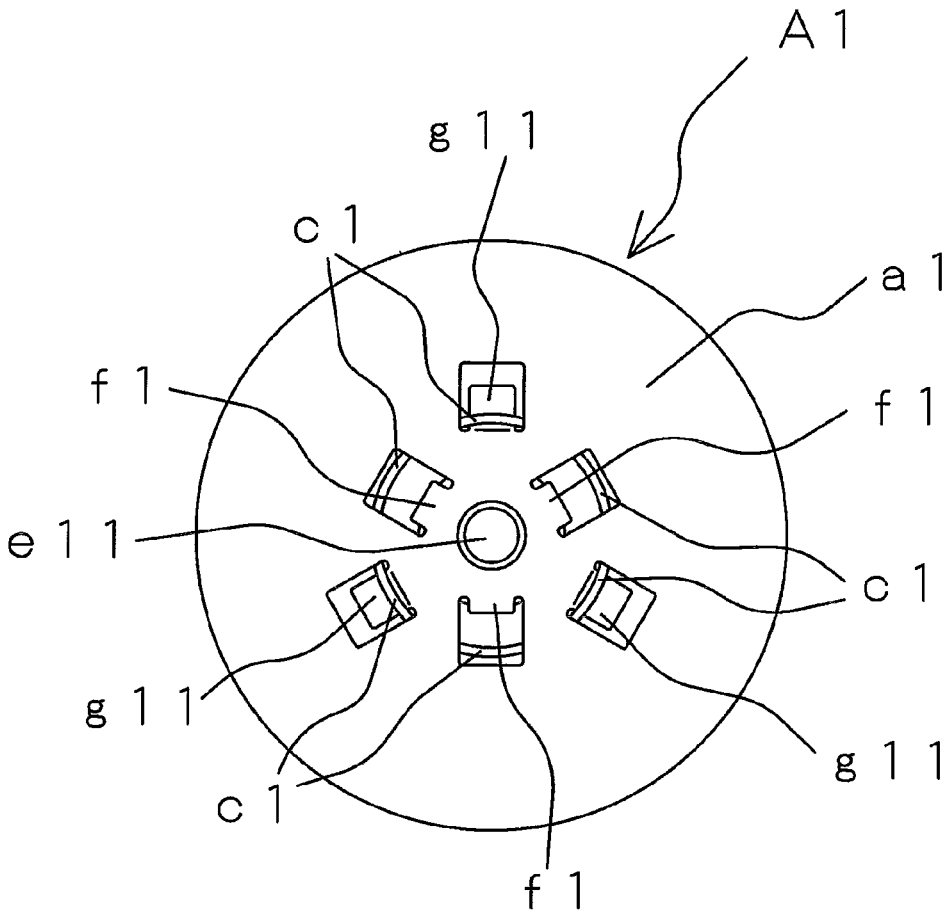
FIG. 1 is a front-view diagram of an embodiment of a furring strip fastening member according to the present invention.
Figure 2:
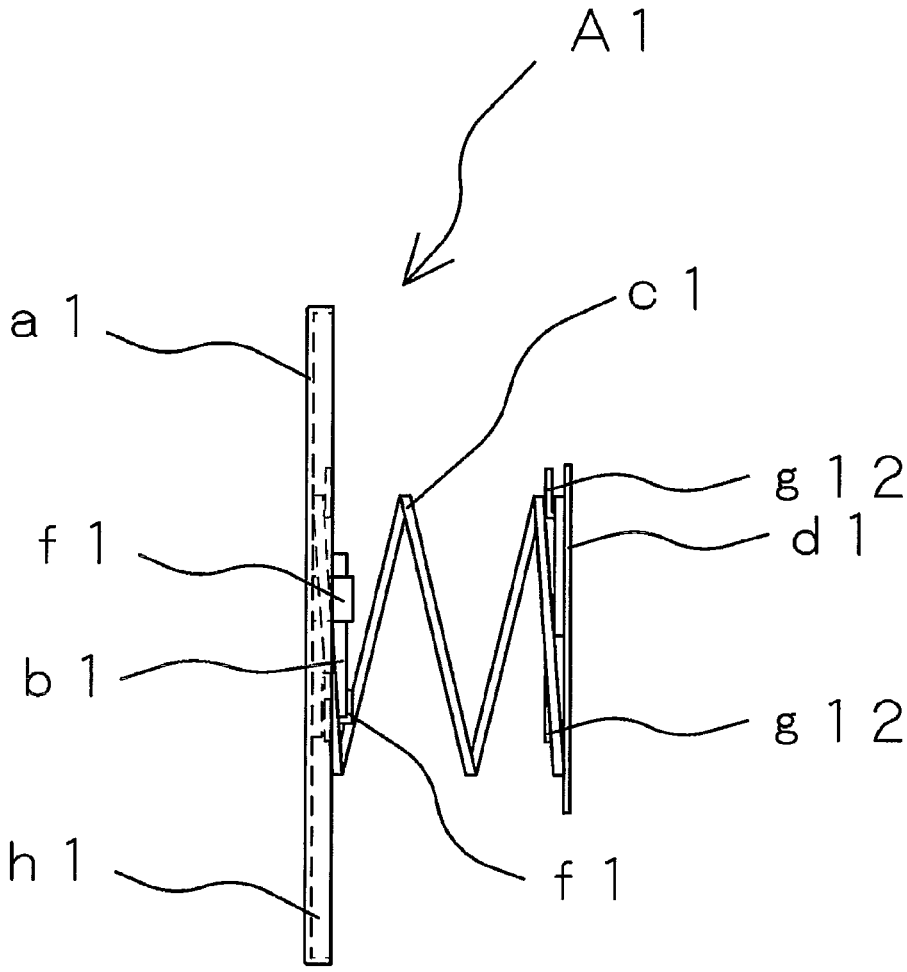
FIG. 2 is a right-view diagram of the furring strip fastening member illustrated in FIG. 1.
Figure 3:
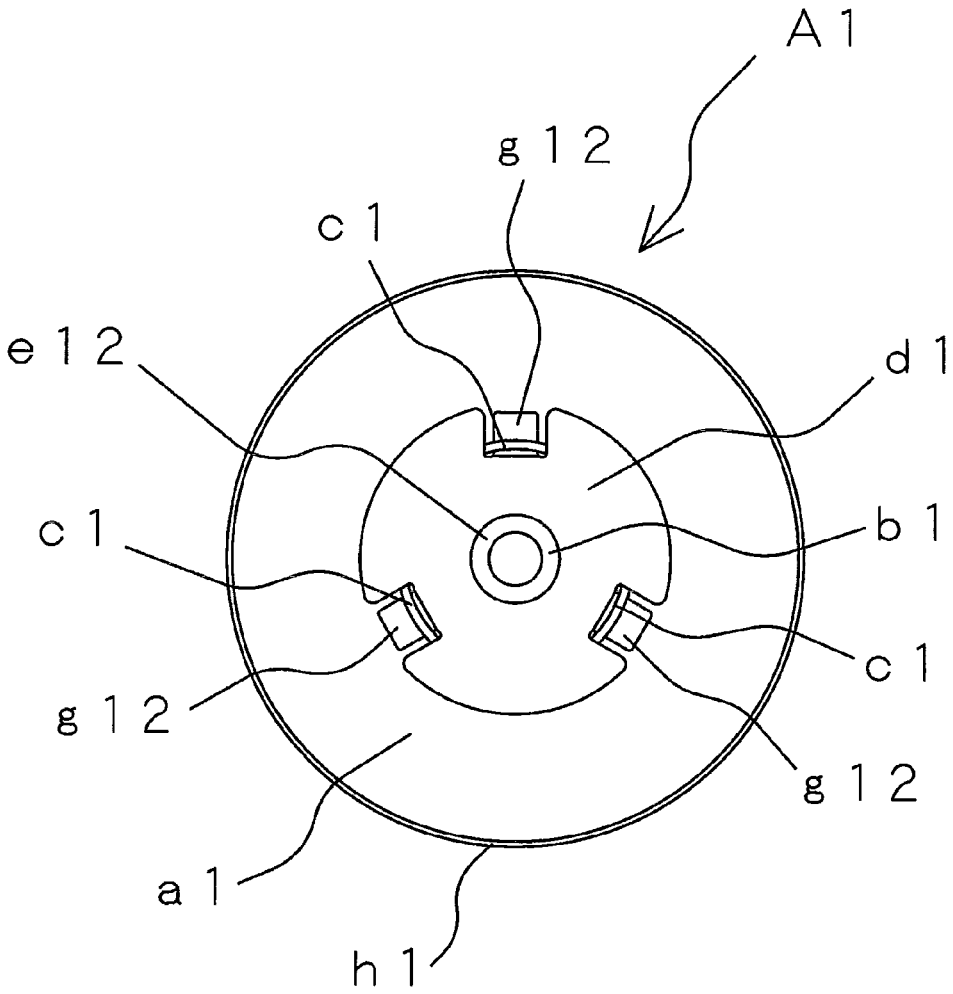
FIG. 3 is a rear-view diagram of the furring strip fastening member illustrated in FIG. 1.

FIGS. 1, 2 and 3 are, respectively, a front-view diagram, a right side-view diagram and a rear-view diagram of an embodiment of a furring strip fastening member according to the present invention. A furring strip fastening member A1 comprises a furring strip receiving plate a1, a female thread section b1, a spring section c1 and a rear face plate d1. The furring strip receiving plate a1 and the rear face plate d1 are shaped as circular flat plates that are mutually opposing. The furring strip receiving plate a1 has, at a central portion, a through-hole e11, female thread section latching sections f1 that protrude so as to face the rear face plate, and protruding spring section latching sections g11. The furring strip receiving plate a1 has also, at the outer edge, a flange h1 that is bent towards the rear face plate. The rear face plate d1 has a through-hole e12 at a central portion, and has spring section latching sections g12 that protrude so as to face the furring strip receiving plate. The spring section c1 is a coiled spring. The spring section c1 is latched by the spring section latching sections g11 of the furring strip receiving plate a1 and by the spring section latching sections g12 of the rear face plate d1. The furring strip receiving plate a1 and the rear face plate d1 are in a connected state by the spring section c1. The female thread section b1 has a through-hole having a thread formed in the inner periphery thereof, and is latched by the female thread section latching sections f1, on a side of the furring strip receiving plate a1 that faces the rear face plate. The female thread section b1 is provided so as to be positioned within the diameter of the spring section c1; also, the through-hole e11 of the furring strip receiving plate a1, the through-hole of the female thread section, and the through-hole e12 of the rear face plate d1 are provided along a straight line, as made clear in FIG. 3, where the female thread section b1 can be seen through the through-hole e12 of the rear face plate d1.

Figure 4:
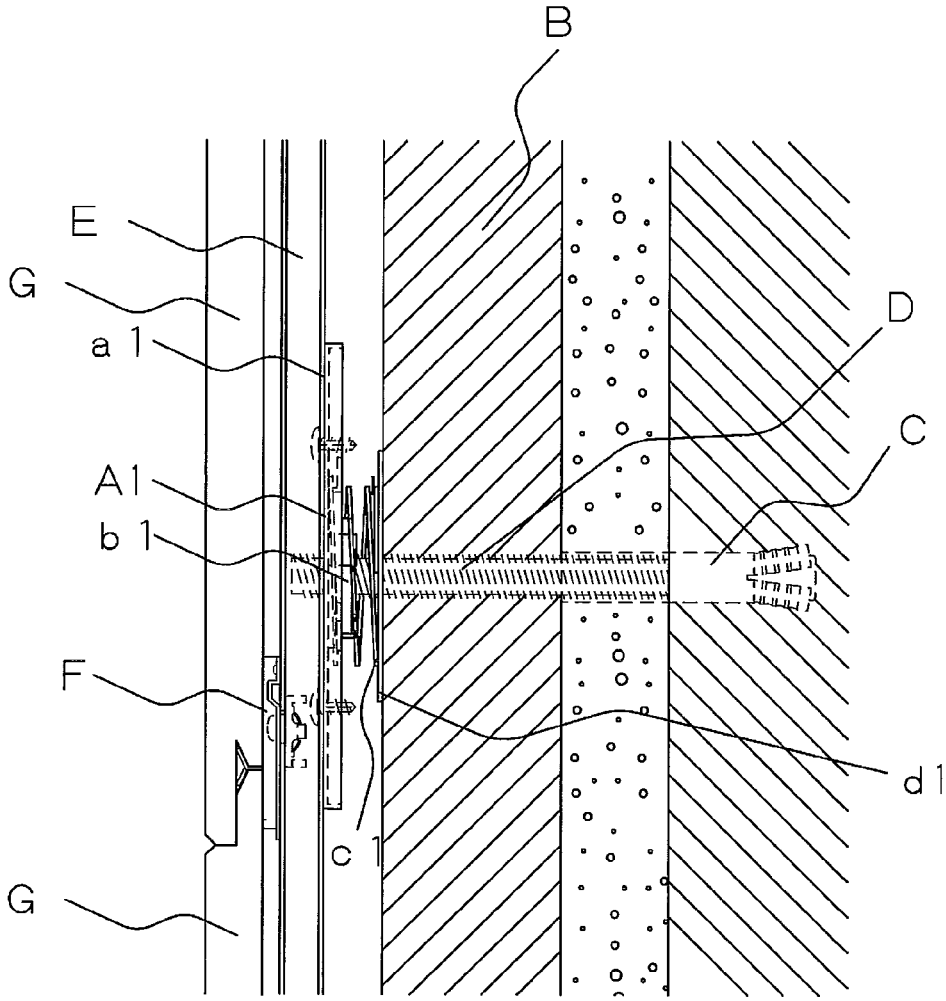
FIG. 4 is vertical cross-sectional diagram illustrating the furring strip fastening member shown in FIG. 1, in an installed state.

FIG. 4 is a vertical cross-sectional diagram illustrating the furring strip fastening member A1 shown in FIG. 1, in an installed state. A skeleton wall of a building comprises a concrete wall and a heat insulating material B disposed outside the concrete wall. An anchor C is driven into the skeleton wall of the building, and a bolt D is mounted to the anchor C. The furring strip fastening member A1 is fixed in a state where the bolt D traverses the through-hole e12 of the rear face plate d1, the through-hole of the female thread section b1 and the through-hole e11 of the furring strip receiving plate a1, and is screwed onto the female thread section b1. A furring strip E is in surface-contact with the furring strip receiving plate a1 of the furring strip fastening member A1, and is fixed to the furring strip receiving plate a1 by way of screws. A siding fastening fixture F is fixed to the furring strip E, and a siding G is fastened by the siding fastening fixture F, to make up thereby the outer wall of the building. The furring strip fastening member A1 of the construction structure illustrated in FIG. 4 comprises the furring strip receiving plate a1, the female thread section b1, the spring section c1 and the rear face plate d1, and has therefore a very simple structure. In the construction structure of FIG. 4, the furring strip receiving plate a1 of the furring strip fastening member A1 presses against the furring strip E, and the rear face plate d1 presses against the heat insulating material B, on account of the reaction of the spring section c1. Therefore, the furring strip fastening member A1 does not loosen readily over the years, or on account of earthquakes or the like, and thus the heat insulating material B can be reliably fixed over long periods of time. In the construction structure of FIG. 4, moreover, the position of the furring strip E is adjusted on the basis of the degree of screwing of the bolt D and the female thread section b1 of the furring strip fastening member A1. Therefore, the siding G exhibits no unevenness. In the construction structure of FIG. 4, the rear face plate d1 of the furring strip fastening member A1 is circular in shape, and hence the rear face plate d1 can easily rotate while pressed against the heat insulating material B during installing, which is made thus easier. The furring strip receiving plate a1 and the rear face plate d1 have spring section latching sections g11, g12, such that the spring section c1 are latched by the spring section latching sections g11, g12. Therefore, the furring strip receiving plate a1, the rear face plate d1 and the spring section c1 form a single whole, which facilitates installing. The furring strip receiving plate a1 has, at the outer edge, the flange h1. Therefore, the furring strip receiving plate a1 has high strength. Also, the female thread section b1 is latched by the female thread section latching sections f1 that are provided in the furring strip receiving plate a1. Therefore, loosening of the bolt D is suppressed, and the furring strip fastening member A1 is fixed firmly.

Figure 5:
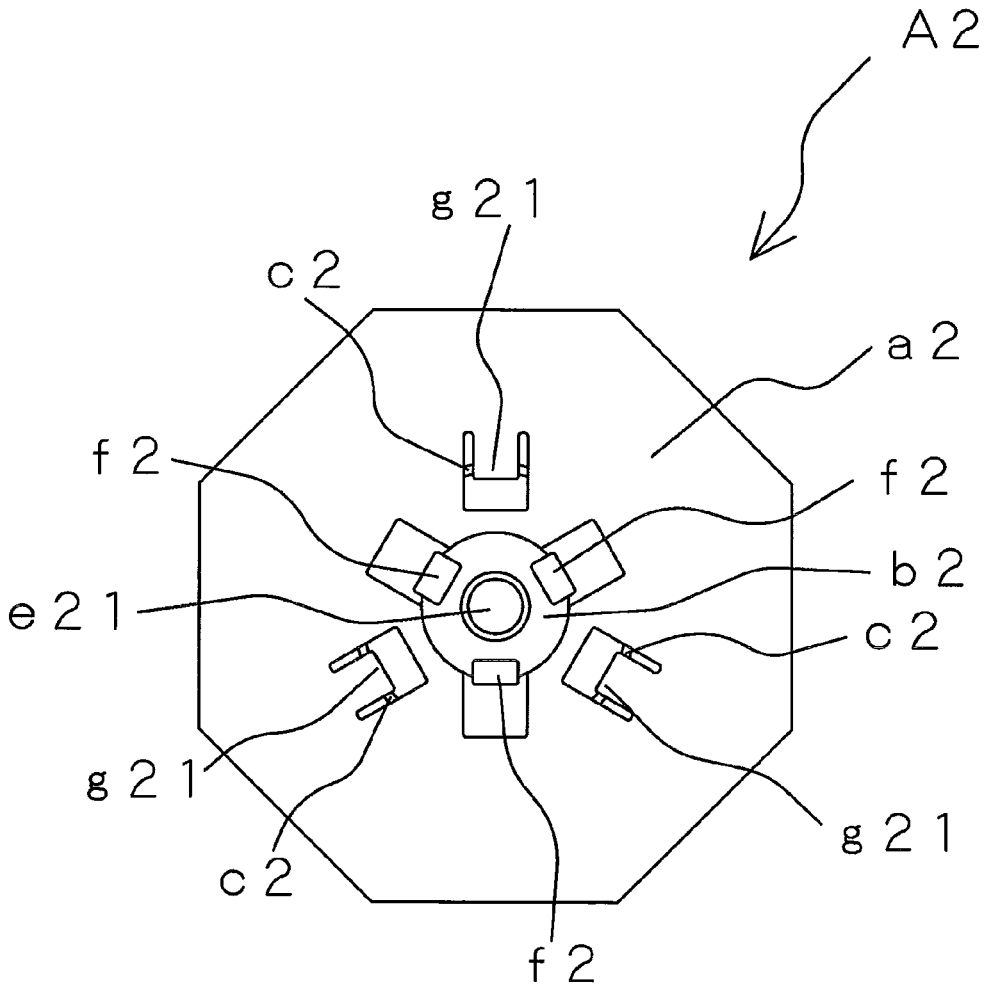
FIG. 5 is a front-view diagram of another embodiment of a furring strip fastening member according to the present invention.
Figure 6:
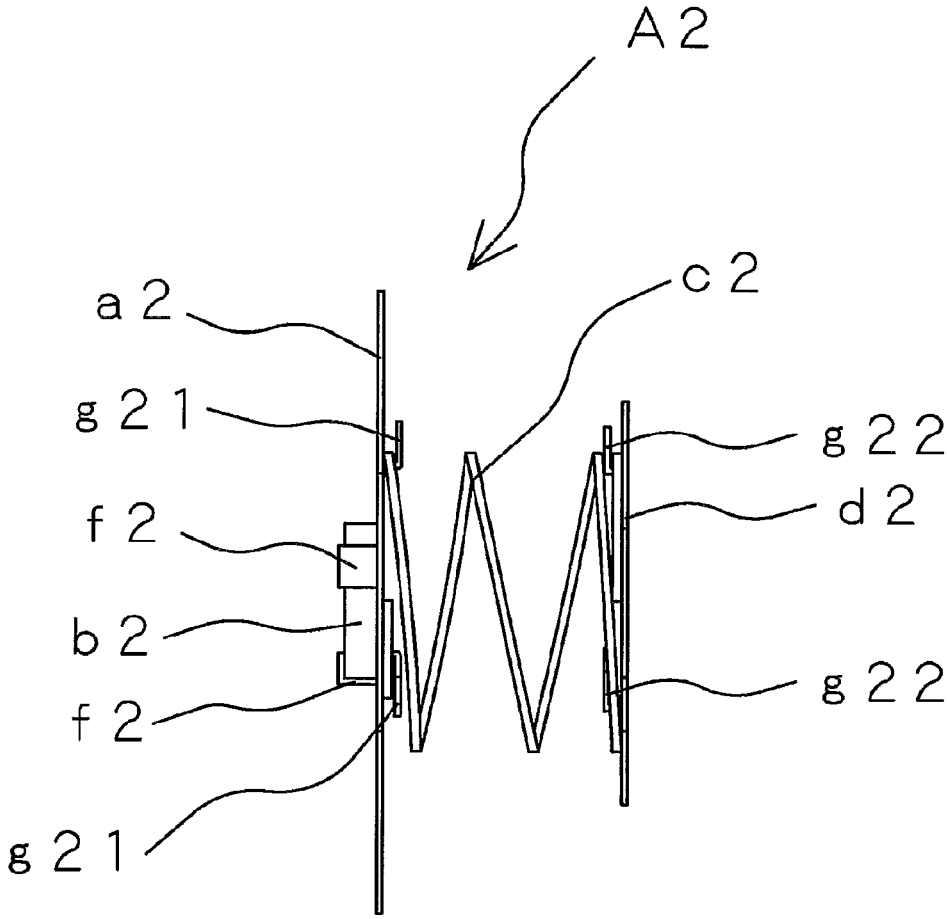
FIG. 6 is a right-view diagram of the furring strip fastening member illustrated in FIG. 5.
Figure 7:
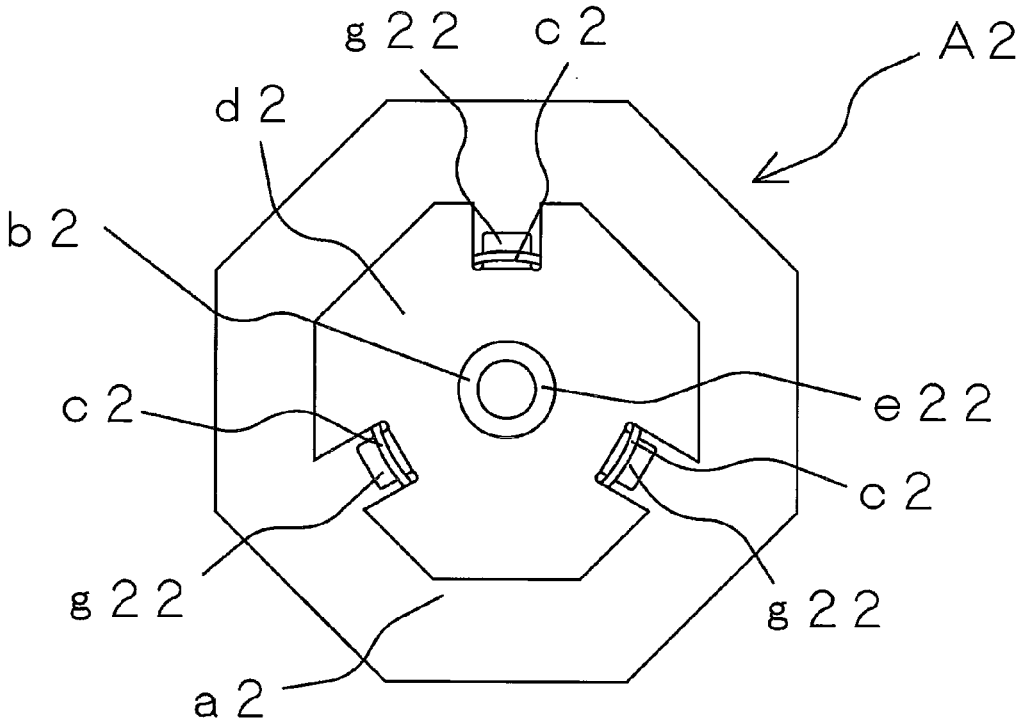
FIG. 7 is a rear-view diagram of the furring strip fastening member illustrated in FIG. 5.

FIGS. 5 to 7 are, respectively, a front-view diagram, a right side-view diagram and a rear-view diagram of another embodiment of a furring strip fastening member according to the present invention. A furring strip fastening member A2 comprises a furring strip receiving plate a2, a female thread section b2, a spring section c2 and a rear face plate d2. The furring strip receiving plate a2 and the rear face plate d2 are mutually opposing. The furring strip receiving plate a2 has, at a central portion, a through-hole e21, as well as female thread section latching sections f2 and spring section latching sections g21. The rear face plate d2 has a through-hole e22 at a central portion, and has spring section latching sections g22 that protrude so as to face the furring strip receiving plate a2. The spring section c2 is a coiled spring. The spring section c2 is latched by the spring section latching sections g21 of the furring strip receiving plate a2 and by the spring section latching sections g22 of the rear face plate d2. The furring strip receiving plate a2 and the rear face plate d2 are in a connected state by the spring section c2. The female thread section b2 has a through-hole having a thread formed in the inner periphery thereof, and is latched by the female thread section latching sections f2. The furring strip fastening member A2, though, differs from the furring strip fastening member A1 in that the furring strip receiving plate a2 is octagonal and has no flange, the female thread section b2 is provided on a side not facing the rear face plate d2, and the rear face plate d2 is octagonal. However, the construction structure illustrated in FIG. 4 can be achieved also using the furring strip fastening member A2, in the same way as in the case of the furring strip fastening member A1. The furring strip fastening member A2 as well has a very simple structure. In the construction structure that uses the furring strip fastening member A2, the furring strip receiving plate a2 presses against the furring strip E, and the rear face plate d2 presses against the heat insulating material B, on account of the reaction of the spring section c2 of the furring strip fastening member A2. Thus, the furring strip fastening member A2 does not loosen readily over the years, or on account of earthquakes or the like, and thus the heat insulating material B can be reliably fixed over long periods of time. Moreover, the position of the furring strip E is adjusted on the basis of the degree of screwing of the bolt D and the female thread section b2 of the furring strip fastening member A2. Therefore, the siding G exhibits no unevenness. In the furring strip receiving plate a2 and the rear face plate d2, the spring section c2 is latched by the spring section latching sections g21, g22. Therefore, the furring strip receiving plate a2, the rear face plate d2 and the spring section c2 form a single whole, which facilitates installing. Also, the female thread section b2 is latched by the female thread section latching sections f2 that are provided in the furring strip receiving plate a2. Therefore, loosening of the bolt D is suppressed, and the furring strip fastening member A2 is fixed firmly.

Embodiments of the present invention have been explained above, but the present invention is not limited thereto, and can be embodied in various manners without departing from the scope of the invention as defined in the appended claims. For instance, the spring sections in the furring strip fastening member may be shaped as disk springs.

As described above, the present invention succeeds in providing a furring strip fastening member, and a construction structure that uses the furring strip fastening member, such that a heat insulating material can be fixed over long periods of time, by way of a simple structure.

What is claimed is:

1. A furring strip fastening member used for fastening a furring strip to a skeleton wall of a building, with a predetermined spacing being provided therebetween, the furring strip fastening member comprising:

a furring strip receiving plate;

a rear face plate;

a spring section; and a female thread section, wherein the furring strip receiving plate and the rear face plate are shaped as flat plates that face each other, the furring strip receiving plate has, in a central portion thereof, a through-hole and has a protruding latching section for latching the female thread section, the rear face plate has a through-hole at a central portion thereof, the spring section connects the furring strip receiving plate and the rear face plate;

the female thread section has a through-hole having a thread formed in an inner periphery thereof, and is latched by the latching section for latching the female thread section, the through-hole of the furring strip receiving plate, the through-hole of the female thread section and the through-hole of the rear face plate are provided along a straight line, and the furring strip receiving plate and the rear face plate each have a latching section for latching the spring section.

2. The furring strip fastening member according to claim 1, wherein the furring strip receiving plate has, at an outer edge thereof, a bent flange.

3. A construction structure for a building, comprising:

the furring strip fastening member according to claim 2;

a furring strip;

a skeleton wall;

a heat insulating material;

an anchor;

a bolt; and a siding, wherein the furring strip is fastened to the skeleton wall of a building by using the furring strip fastening member the skeleton wall of the building is formed of a concrete wall and the heat insulating material disposed outside the concrete wall, the anchor is driven into the skeleton wall of the building, the bolt is mounted to the anchor, the furring strip fastening member is connected in a state where the bolt traverses the through-hole in the rear face plate and the bolt and the female thread section are screwed together, the furring strip is connected to the furring strip fastening member, the siding is fastened to the furring strip, and in the furring strip fastening member, the furring strip receiving plate presses against the furring strip and the rear face plate presses against the heat insulating material, by means of reaction of the spring section.

4. The furring strip fastening member according to claim 1, wherein the rear face plate is substantially circular.

5. A construction structure for a building, comprising:

the furring strip fastening member according to claim 4;

a furring strip;

a skeleton wall;

a heat insulating material;

an anchor;

a bolt; and a siding, wherein the furring strip is fastened to the skeleton wall of a building by using the furring strip fastening member the skeleton wall of the building is formed of a concrete wall and the heat insulating material disposed outside the concrete wall, the anchor is driven into the skeleton wall of the building, the bolt is mounted to the anchor, the furring strip fastening member is connected in a state where the bolt traverses the through-hole in the rear face plate and the bolt and the female thread section are screwed together, the furring strip is connected to the furring strip fastening member, the siding is fastened to the furring strip, and in the furring strip fastening member, the furring strip receiving plate presses against the furring strip and the rear face plate presses against the heat insulating material, by means of reaction of the spring section.

6. The furring strip fastening member according to claim 1, wherein the latching section for latching the spring section of the rear face plate is provided on a side that faces the furring strip receiving plate.

7. The furring strip fastening member according to claim 1, wherein the female thread section is latched, by the latching section for latching the female thread section, on a side of the furring strip receiving plate that faces the rear face plate.

8. A construction structure for a building, comprising:

the furring strip fastening member according to claim 1;

a furring strip;

a skeleton wall;

a heat insulating material;

an anchor;

a bolt; and a siding, wherein the furring strip is fastened to the skeleton wall of a building by using the furring strip fastening member the skeleton wall of the building is formed of a concrete wall and the heat insulating material disposed outside the concrete wall, the anchor is driven into the skeleton wall of the building, the bolt is mounted to the anchor, the furring strip fastening member is connected in a state where the bolt traverses the through-hole in the rear face plate and the bolt and the female thread section are screwed together, the furring strip is connected to the furring strip fastening member, the siding is fastened to the furring strip, and in the furring strip fastening member, the furring strip receiving plate presses against the furring strip and the rear face plate presses against the heat insulating material, by means of reaction of the spring section.

9. The construction structure for a building according to claim 8, wherein the position of the furring strip is adjusted on the basis of a position of screwing between the bolt and the female thread section of the furring strip fastening member.

10. A furring strip fastening member used for fastening a furring strip to a skeleton wall of a building, with a predetermined spacing being provided therebetween, the furring strip fastening member comprising:

a furring strip receiving plate;

a rear face plate, a spring section; and a female thread section, wherein the furring strip receiving plate and the rear face plate are shaped as flat plates that face each other, the furring strip receiving plate has, in a central portion thereof, a through-hole and has a protruding latching section for latching the female thread section, the rear face plate has a through-hole at a central portion thereof, the spring section connects the furring strip receiving plate and the rear face plate;

the female thread section has a through-hole having a thread formed in an inner periphery thereof, and is latched by the latching section for latching the female thread section, the through-hole of the furring strip receiving plate, the through-hole of the female thread section and the through-hole of the rear face plate are provided along a straight line, and the female thread section is latched, by the latching section for latching the female thread section, on a side of the furring strip receiving plate that does not face the rear face plate.

11. A construction structure for a building, comprising:

the furring strip fastening member according to claim 10;

a furring strip;

a skeleton wall;

a heat insulating material;

an anchor;

a bolt; and a siding, wherein the furring strip is fastened to the skeleton wall of a building by using the furring strip fastening member the skeleton wall of the building is formed of a concrete wall and the heat insulating material disposed outside the concrete wall, the anchor is driven into the skeleton wall of the building, the bolt is mounted to the anchor, the furring strip fastening member is connected in a state where the bolt traverses the through-hole in the rear face plate and the bolt and the female thread section are screwed together, the furring strip is connected to the furring strip fastening member, the siding is fastened to the furring strip, and in the furring strip fastening member, the furring strip receiving plate presses against the furring strip and the rear face plate presses against the heat insulating material, by means of reaction of the spring section.

* * * * *